US006827469B2

(12) United States Patent
Coushaine et al.

(10) Patent No.: US 6,827,469 B2
(45) Date of Patent: Dec. 7, 2004

(54) SOLID-STATE AUTOMOTIVE LAMP

(75) Inventors: Charles M. Coushaine, Rindge, NH (US); Steven C. Sidwell, Hopkington, NH (US); Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/625,819

(22) Filed: Jul. 23, 2003

(65) Prior Publication Data

US 2004/0150995 A1 Aug. 5, 2004

Related U.S. Application Data

(60) Provisional application No. 60/444,566, filed on Feb. 3, 2003.

(51) Int. Cl.[7] ..... F21V 29/00
(52) U.S. Cl. ..... 362/294; 362/249; 362/800
(58) Field of Search ..... 362/96, 249, 255, 362/256, 294, 373, 800

(56) References Cited

U.S. PATENT DOCUMENTS

| | | | | |
|---|---|---|---|---|
| 5,688,042 A | * | 11/1997 | Madadi et al. | 362/373 |
| 5,857,767 A | * | 1/1999 | Hochstein | 362/294 |
| 6,425,678 B1 | * | 7/2002 | Verdes et al. | 362/294 |
| 6,582,100 B1 | * | 6/2003 | Hochstein et al. | 362/294 |

* cited by examiner

*Primary Examiner*—Y My Quach Lee
(74) *Attorney, Agent, or Firm*—William E. Meyer

(57) ABSTRACT

A solid-state lamp has a base formed to be received into a socket, and the base has a retainer receptacle formed therein. An axially extending support is fitted into the base. The support is formed of an electrically conductive, heat-sinking material and has a retainer engaging the retainer receptacle. An electrically insulating coating is formed on the support and electrically conductive traces are formed on the insulating coating. A plurality of solid-state light sources are formed on the support and are electrically connected to the traces, at least two of the traces providing electrical connection to the base whereby electrical connection can be made to the socket. The plurality of solid-state light sources are formed in a selected area of the support and in a preferred embodiment mimic the dual filaments of a prior art lamp.

11 Claims, 7 Drawing Sheets

SOLID-STATE AUTOMOTIVE LAMP

TECHNICAL FIELD

The Applicants hereby claim the benefit of their provisional application, Ser. No. 60/444,566 filed Feb. 3, 2003 titled SOLID-STATE AUTOMOTIVE LAMP.

This invention relates to lamps and more particularly to solid-state lamps. Still more particularly, it relates to solid-state lamps that mimic the focal characteristics of incandescent lamps, for example, those used in automotive applications.

BACKGROUND ART

Small incandescent lamps have many uses in automobiles, for example, in turn signals and brake lights, etc. Many of these lamps have dual filaments that, when the lamp is used with a suitable reflector, provide particular focal characteristics that are useful such automotive designs. These incandescent lamps are generally provided with one of two types of bases: a wedge base or a bayonet base. In the past, lamps with conventional Edison bases have also been used. Incandescent lamps of this sort are subject, of course, to all of the pitfalls of such lamps, such as filament breakage due to use or to shock. It would be an advance in the art if a lamp could be provided that did not suffer from these disadvantages.

DISCLOSURE OF INVENTION

It is, therefore, an object of the invention to obviate the disadvantages of the prior art. It is another object of the invention to enhance the operation of automotive lamps. Still another object of the invention is the provision of a solid-state lamp that mimics the focal characteristics of incandescent lamps. These objects are accomplished, in one aspect of the invention, by a solid-state lamp that comprises a base formed to be received into a socket, the base having a retainer receptacle formed therein. An axially extending support is fitted into the base, the support being formed of an electrically conductive, heat-sinking material and having a retainer that engages the retainer receptacle. An electrically insulating coating is formed on the support and electrically conductive traces are formed on the insulating coating, thus forming a printed circuit board. A plurality of solid-state light sources is formed on the support and electrically connected to the traces, at least two of the traces provide electrical connection to the base whereby electrical connection can be made to the socket. The solid-state light sources are formed in a selected area of said support.

In a preferred embodiment of the invention, the location of the light sources mimics the focal characteristics of an incandescent lamp.

The solid-state lamp avoids all of the shortcomings of the incandescent lamp it is designed to replace and additionally has an extremely long life, and offers the added safety of fast light up rise time. When the turn signal loading is not required, there is also a power consumption benefit. The units offer a unique appearance and provide the proper color without the need for colored lensing.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
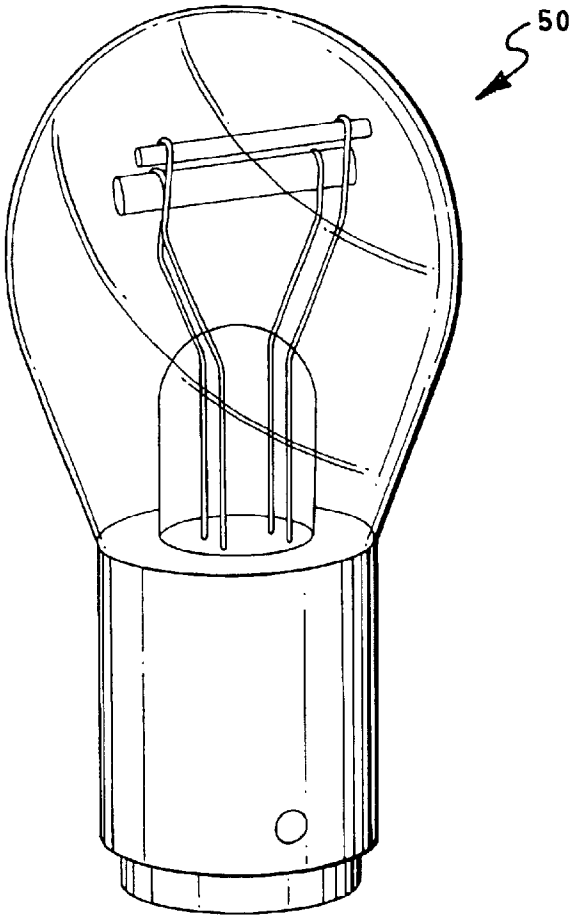
FIG. 1 PRIOR ART
FIG. 1 is a perspective view of a prior art lamp with a bayonet base.

Referring now to the drawings with greater particularity, there is shown in FIG. 1 a prior art incandescent dual filament lamp 50 that can be used as the combination stop lamp and tail lamp or park and turn lamp in an automotive vehicle. Lamp 50 has a bayonet base.

Figure 2:
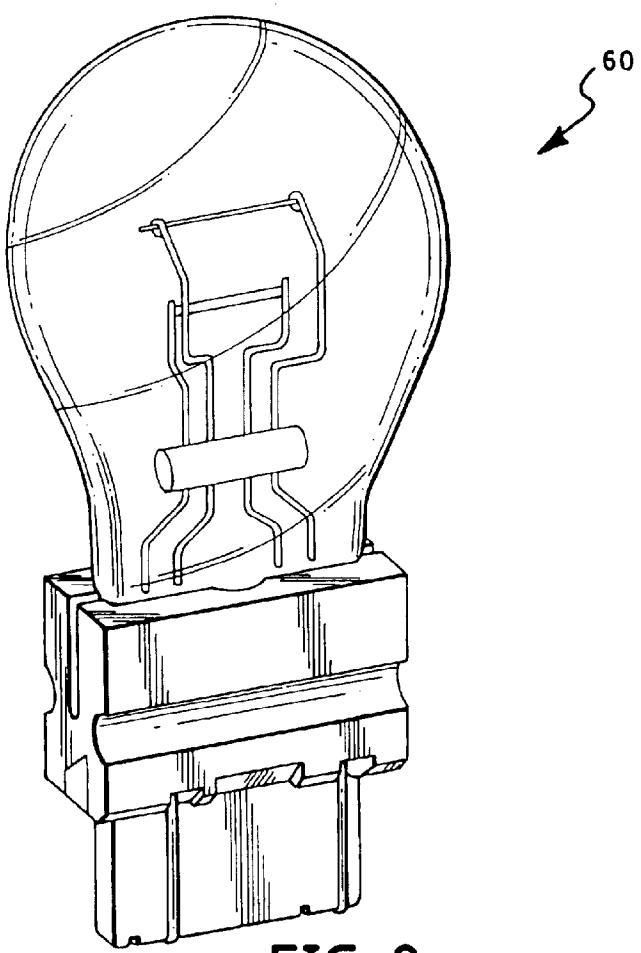
FIG. 2 PRIOR ART
FIG. 2 is a perspective view of a prior art lamp with a wedge base.

FIG. 2 details a second prior art lamp 60 with similar characteristics but having a wedge base.

Figure 4:
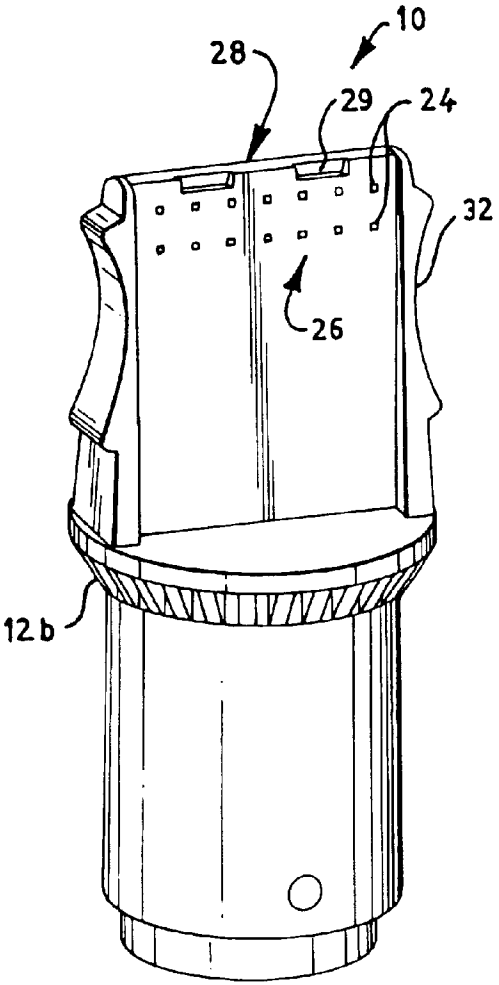
FIG. 4 is a perspective view of another embodiment of the invention.
Figure 3:
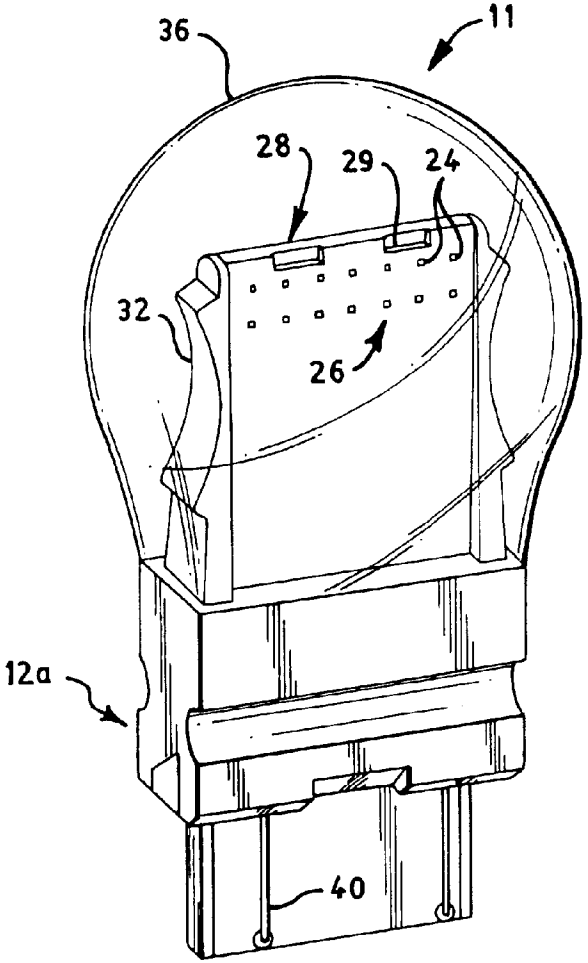
FIG. 3 is perspective view of an embodiment of the invention.
Figure 6:
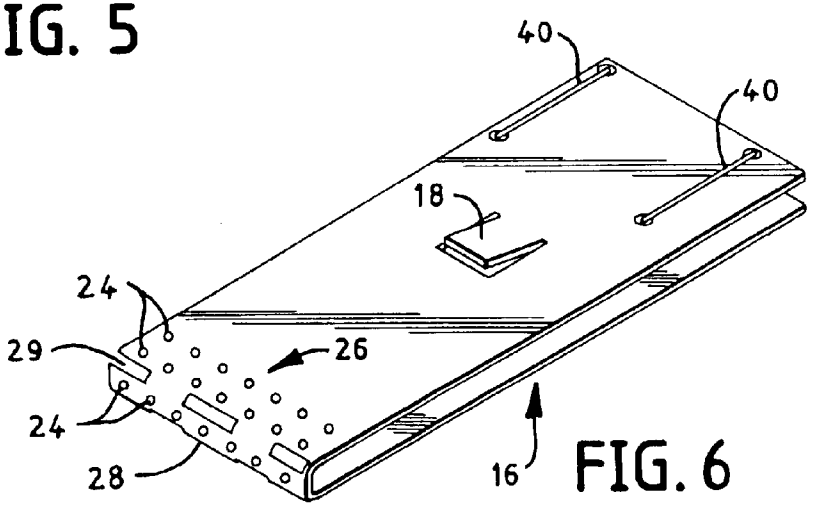
FIG. 6 is a perspective view of the support of the invention after bending.
Figure 8:
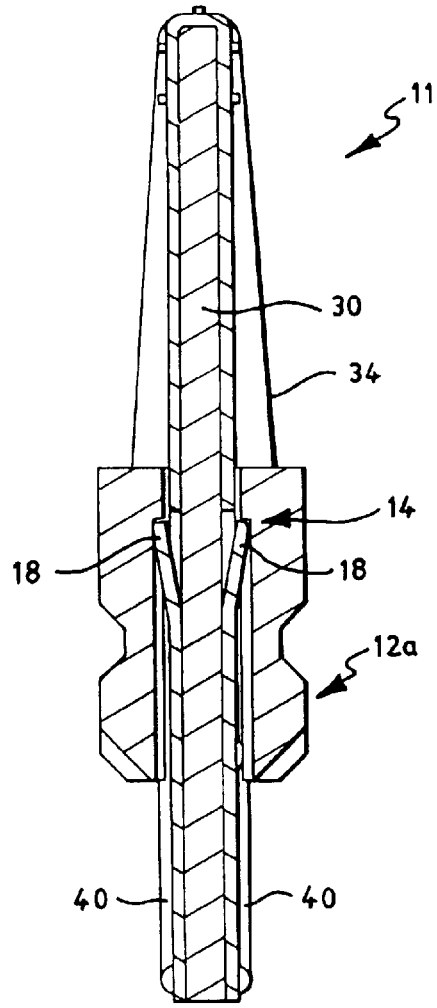
FIG. 8 is an elevational sectional view taken along the line 8—8 of FIG. 7.
Figure 9:
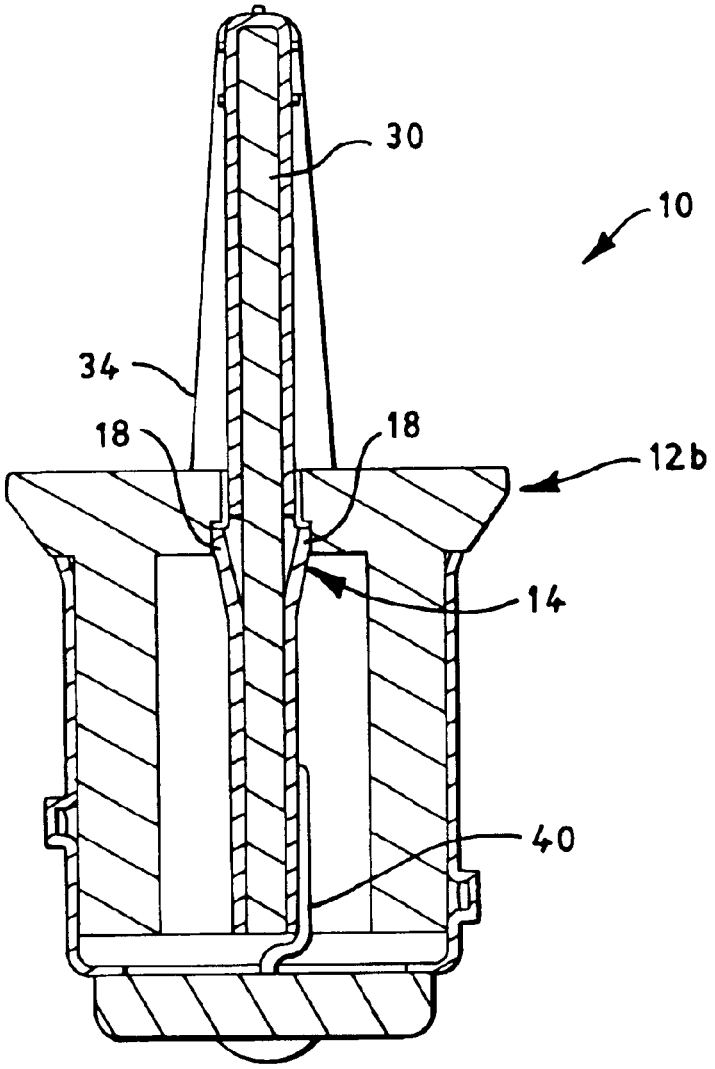
FIG. 9 is an elevational sectional view similar to FIG. 8 of another embodiment of the invention.

In FIGS. 3 and 4 there are shown solid-state lamps 10 and 11 having a base formed to be received into a socket (not shown). In FIG. 3 a base 12*a* is formed to accommodate a wedge base, and in FIG. 4 the base 12*b* is formed to accommodate a bayonet base. Both base 12*a* and base 12*b* have one or more retainer receptacles 14 formed therein (see for example FIG. 8). An axially extending support 16 (FIGS. 6, 10) is fitted into the base and contains at least one or more retainers 18 formed therein and engaging the retainer receptacles 14. The support 16 is electrically conductive and provides heat-sinking characteristics and in a preferred embodiment is aluminum having a thickness sufficiently thin that the support 16 may be bent without fracturing the support. The Applicants have used an aluminum support with a thickness of 0.5 mm.

Figure 5:
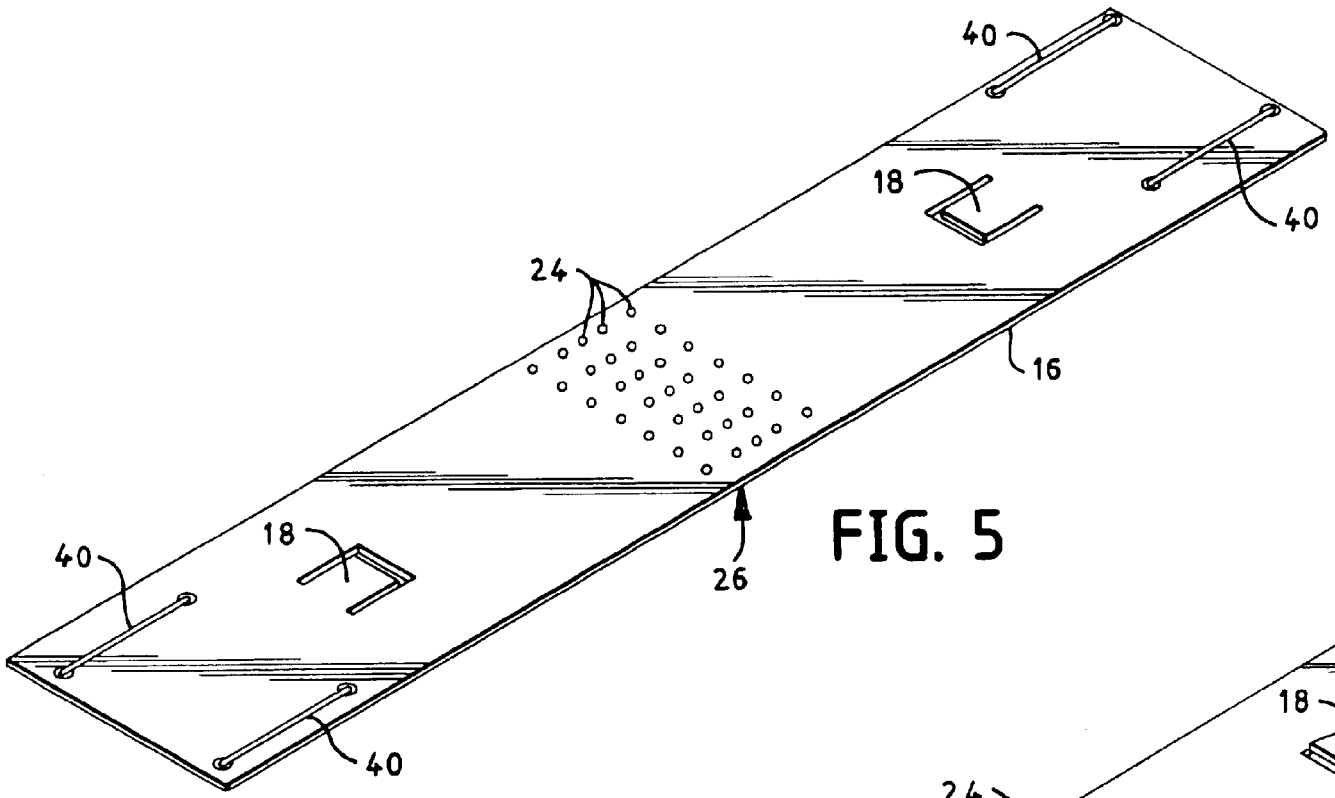
FIG. 5 is a perspective view of the support of the invention in a planar form of the embodiment of the invention shown in FIG. 3.
Figure 10:
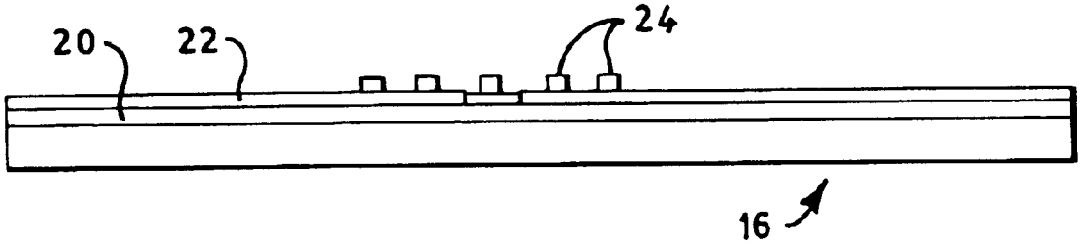
FIG. 10 is a diagrammatic sectional view of the support of the invention showing the various layers.

Provided on at least one surface of support 16 is an electrically insulating coating 20 (see FIG. 10). The coating 20 in turn supports is two or more electrically conductive traces 22 in a desired electrical pattern. Held on the support 16 by conventional connection techniques and electrically connected to the traces 22, are one or more solid-state light sources 24. The light sources 24 are formed in a selected area 26 (FIG. 5) of the support 16. In the preferred embodiment, the light sources are arranged in one or more lines, or in a linear extending array, or similarly arranged to mimic the optical shape or outline of a filament as would be typical of a corresponding filament lamp. In the embodiment shown, the area 26 is substantially in the center of support 16 when support 16 is in its planar mode as is shown in FIG. 5. Lead-in wires 40 can be provided on the edges of the support 16 for making electrical connection to the traces 22 and an external circuit via the appropriate socket. Finger grips 32 may formed on the edges of core 30 to aid in the insertion process, both in fitting the support 16 into the base and inserting the lamp into a socket.

Figure 7:
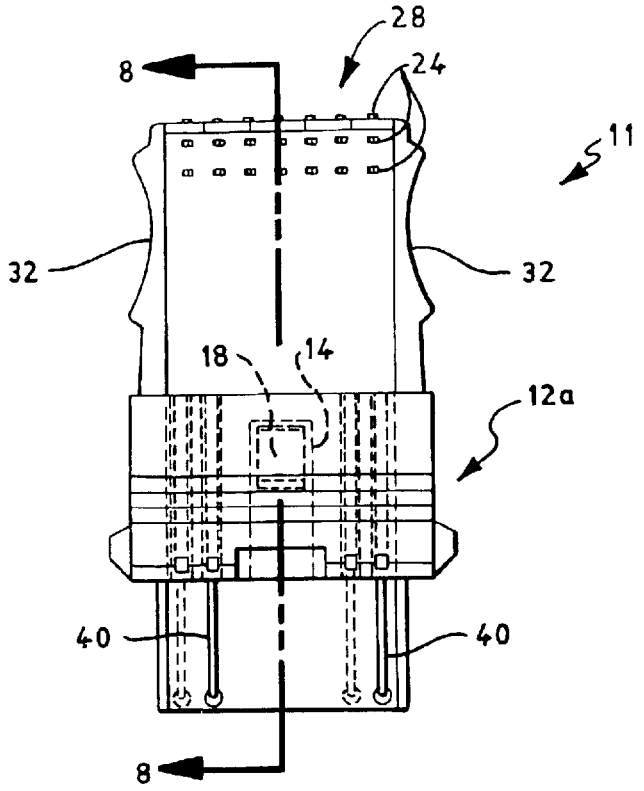
FIG. 7 is a diagrammatic elevational view of the embodiment of the invention shown in FIG. 3.

After the light sources 24 are applied to the support 16, the support is bent into a U shape (see FIG. 6) and inserted in the base, for example 12*a*, or 12*b*, with the bight 28 remote from the base. The traces 22 may extend across the end region. In the preferred embodiment, the bend region 26 supports a row of light sources 24 facing axially away from the base. If the thickness of the support 16 is not great, there is a relatively little stretch in the traces 22 as they extend across the besnd region. The traces 22 then remain contguous across the bend region. The preferred support and light source assembly is maintained in position in the base by the retainers 18 engaging the retainer receptacles 14. Alternatively, other retention structures, clips, latches, glue, friction, or other methods of securely coupling the support 16 in the base 12*a*, 12*b* may be used. In the wedge base embodiment (FIGS. 3, 7, 8) the lead-in wires may be exposed on the base 12*a* exterior for direct electrical contact in a socket, similar to the connection used in the S-8 wedge lamp (FIG. 2). To aid in the bending operation it is preferred that slots 29 be provided in support 16 adjacent the bend area.

An axially extending core 30 is provided with the bases 12*a* and 12*b* and the U-shaped support 16 encompasses the core on at least two sides. The core 30 may be made from a material with a high heat conductivity to enhance the conduction of heat away from the light sources 24. The core 30 may be joined to the base 12. In the preferred embodiment, the core 30 is a formed portion of the base, dividing the receptacle in two.

In a preferred embodiment of the invention a light-transmissive add-on piece 34, or a coating, such a silicone or urethane as known in the art is applied over the light sources 24, preferably after the bending has occurred.

Alternatively or in conjunction with the light-transmissive coating, a glass envelope 36 may be provided. Such an envelope 36 not only aids in weatherproofing the lamps, but also conforms the lamps visual appearance more closely with what has existed in the prior art, making the; lamp appear more familiar to customers.

Figure 11:
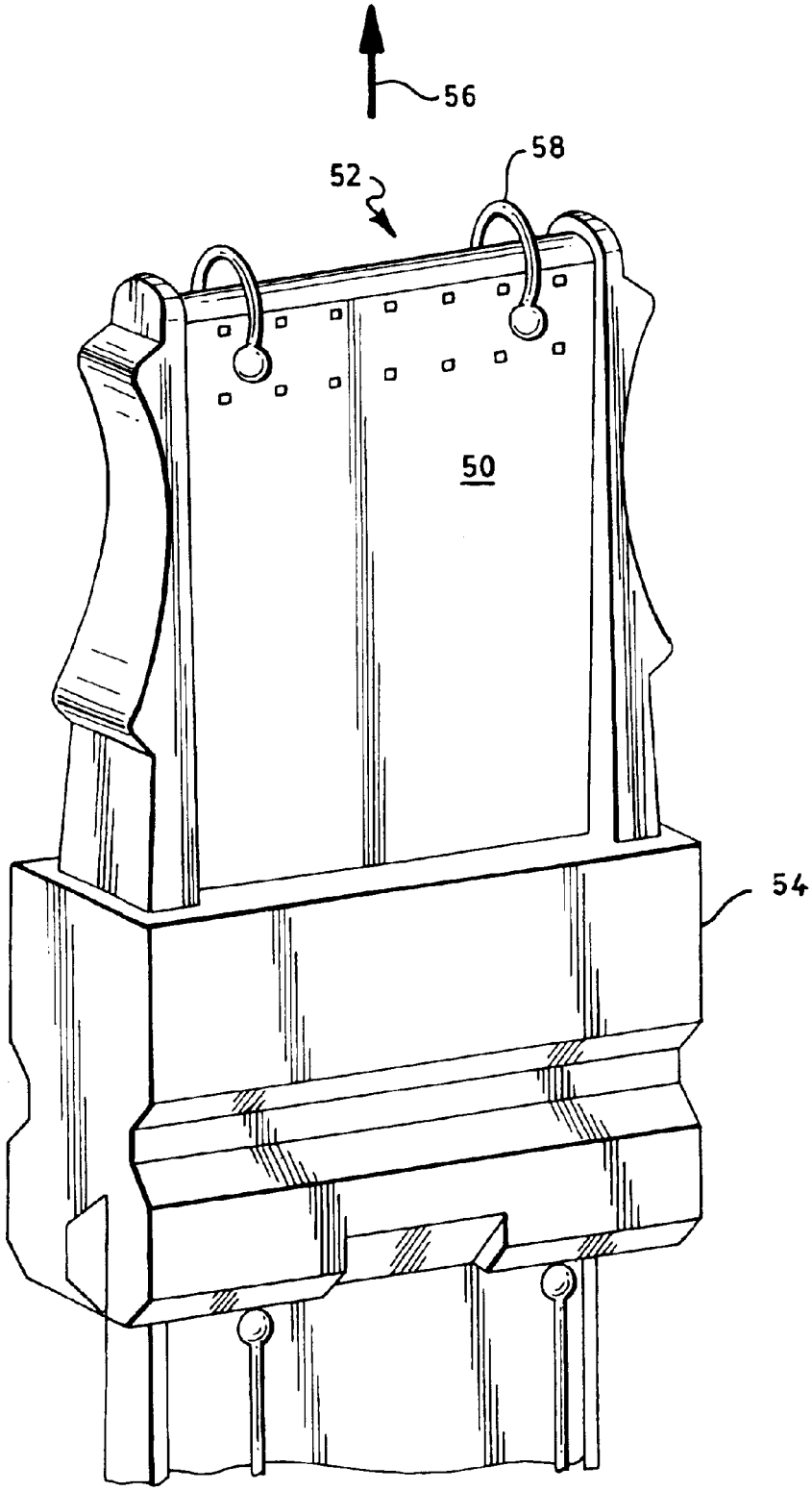
FIG. 11 is an elevational sectional view of another embodiment of the invention.
Figure 12:
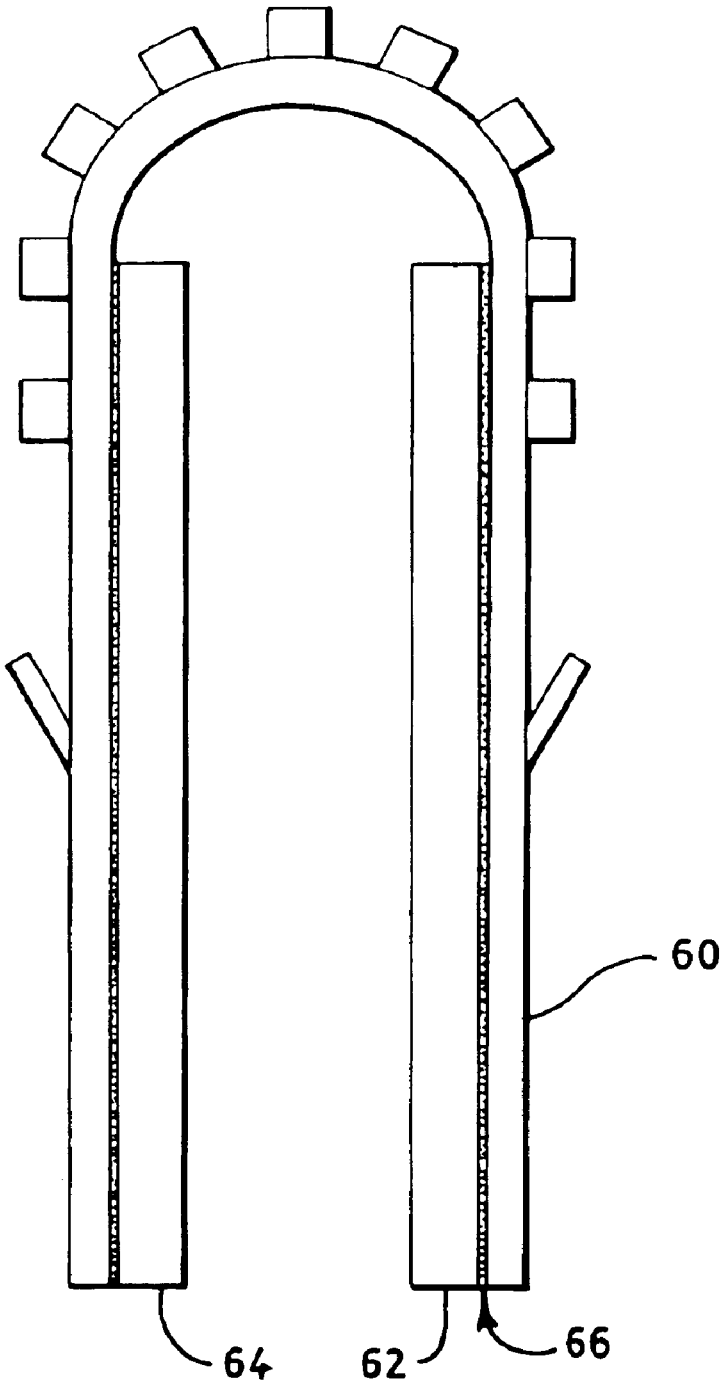
FIG. 12 is an elevational sectional view of another embodiment of the board assembly using attached heat sinks.

FIG. 11 is an elevational sectional view an alternative embodiment of the invention. Depending on the base and circuit materials used, if the bend does not maintain trace integrity, then the single board may be replaced with with a two board construction. Each of the two support boards 50, 52 are inserted into slots in the base 54 to parallel to the base 56 axis. An interconnect is then made between the two parallel boards 50, 52 such as a bridge wire 58 connecting the circuit traces on each board. The two board assembly would be similarly coated, or enclosed as previously described. The two board assembly enables the use of heavier heat sinking boards 50, 52, but comes at the expense of reduced manufacturing ease, and possibly the loss of the LEDs positioned along the top of the lamp assembly. This is then considered a viable, albeit at present, a less desirable embodiment. A further embodiment is to blend the bent embodiment and the two board embodiment by forming a the bent structure with a relatively thin wall support 60. One or two heavy heat sinks 62, 64 are then attached to the to interior sides of thin bent support 60 using a thermally conductive cement 66. The assembly is then similarly inserted in a base, and latched in place, and coated or enclosed. FIG. 12 is an elevational sectional view an alternative embodiment of the board assembly using attached heat sinks.

Thus there is provided a solid-state lamp with applicability to automotive uses. It mimics the focal characteristics of corresponding filamented lamps, but has a longer life expectancy and is more rugged than the prior filamented lamps.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A solid-state lamp comprising:

a base formed to be received into a socket, said base having a receptacle formed therein;

an axially extending, U-shaped support having its bight remote from said base fitted into said base, said U-shaped support being formed of an electrically conductive, heat-sinking material;

an electrically insulating coating on said support and electrically conductive traces on said insulating coating; and a plurality of solid-state light sources formed on said support and electrically connected to said traces, at least two of said traces providing electrical connection to said base whereby electrical connection can be made to said socket; said plurality of solid-state light sources being formed in a selected area of said support.

2. The solid state lamp of claim 1 wherein the base receptacle includes a retainer receptacle formed therein; and the support includes a retainer engaging said retainer receptacle.

3. The solid-state lamp of claim 2 wherein said base has an axially extending core and said U-shaped support encompasses said core on at least two sides.

4. The solid-state lamp of claim 1 wherein said base fits in a pre-existing socket designed for a filamented lamp, and said plurality of solid-state light sources located on said support mimic the location of a filament in such a filamented lamp designed for such pre-existing socket.

5. The light source of claim 1 wherein said support is aluminum.

6. The solid-state lamp of claim 1 wherein a light-transmitting envelope surrounds said support.

7. A method of making a solid-state lamp comprising the steps of:

forming a base including at least one retainer receptacle, said base including electrical contacts;

forming a planar, electrically conductive support;

applying an electrically insulating layer to at least one surface of said support;

applying a plurality of electrically conductive traces on said insulating layer;

applying one or more solid-state light sources in a selected area on said support in contact with said electrically conductive traces;

subsequently reshaping the support; and inserting said reshaped support into said base and engaging at least some of said electrical traces with said electrical contacts.

8. The method of claim 7 further including the step of forming at least one retainer support and coupling said support to said base by said retainer.

9. The method of claim 7 wherein the step of reforming the support includes bending the support in a region including at least a portion of the traces.

10. The method of claim 7 further including the step of applying a light transmissive coating over at least a portion of said support and said solid-state light sources.

11. The method of claim 7 further including the step of fitting a light-transmitting envelope over the light sources and at least a portion of the support.

* * * * *